United States Patent [19]

Ross et al.

[11] 3,947,152

[45] Mar. 30, 1976

[54] PRINTING PRESS CENTRIFUGAL PUMP ASSEMBLY

[75] Inventors: Joseph Ross, Brooklyn; Ernest Frederick Fuchs, Middle Village, both of N.Y.

[73] Assignee: Ace Envelope Manufacturing Corporation, New York, N.Y.

[22] Filed: July 1, 1974

[21] Appl. No.: 484,429

[52] U.S. Cl. ..... 417/360; 64/1 V; 101/366; 403/301; 403/329; 403/354; 417/424

[51] Int. Cl.[2] ..... F04B 39/14

[58] Field of Search ..... 417/424, 359, 360; 403/362, 329, 354, 301; 101/364, 366; 64/1 V, 1 R

[56] References Cited

UNITED STATES PATENTS

| | | | |
|---|---|---|---|
| 1,532,662 | 4/1925 | Risser | 403/301 |
| 2,445,182 | 7/1948 | Odey | 417/359 |
| 2,650,537 | 9/1953 | Rosse | 101/366 |
| 2,764,100 | 9/1956 | Maisch | 417/360 |
| 2,934,245 | 4/1960 | Emeny | 417/360 |
| 3,056,911 | 10/1962 | Hart et al. | 417/424 |
| 3,075,459 | 1/1963 | Hoelzer et al. | 101/366 |
| 3,169,403 | 2/1965 | McGinn | 403/329 |
| 3,199,745 | 8/1965 | Hollis et al. | 417/424 |
| 3,280,439 | 10/1966 | McCarthy | 403/354 |
| 3,462,726 | 8/1969 | Stark et al. | 403/329 |

*Primary Examiner*—C. J. Husar
*Attorney, Agent, or Firm*—Philip D. Amins

[57] ABSTRACT

A centrifugal pump assembly especially adapted for use in conjunction with ink reservoirs of printing press apparatuses. There is provided a centrifugal pump assembly comprising motor mounting means for mounting the motor with respect to the cover member of an ink reservoir. The shaft of the motor extends downwardly into the reservoir and has secured thereto a coupling sleeve. The coupling sleeve includes means for securing the same to the motor shaft and means for releasably engaging the impeller shaft of the pump assembly. The impeller shaft is provided with a positive drive pin adapted to fit into a slot formed in the coupling sleeve to thereby properly align said impeller shaft with respect to the impeller housing and to insure proper positive connection of the impeller shaft with respect to the motor shaft for corresponding rotational movement therewith. The releasable engagement of the impeller shaft with respect to the motor shaft permits disengagement of the motor from the centrifugal pump assembly prior to washing and cleansing operations of the impeller assembly and ink reservoir.

26 Claims, 6 Drawing Figures

PRINTING PRESS CENTRIFUGAL PUMP ASSEMBLY

BACKGROUND OF THE INVENTION

The present invention pertains to a new and novel centrifugal pump assembly and, more particularly, to a centrifugal pump assembly for use in conjunction with ink reservoirs employed in printing presses.

Prior art centrifugal pump assemblies employed in conjunction with printing operations have presented serious problems when the cleaning of the ink reservoir and impeller assemblies have been required. In this regard, these prior art pump assemblies incorporated electrical motors which were fixedly secured to the impeller assembly and to the reservoir cover plate. Thus, when the impeller assembly and reservoir cover were to be cleansed, to remove ink accumulations or change the color of ink employed, care had to be taken not to have the cleansing solution contaminate the motor. Since the workmen employed to complete these tasks were not usually careful, many motors were burned out necessitating complete disassembly of the centrifugal pump assembly and replacement of the motor. The frequency of motor replacement was very high and extremely costly from both a material and labor point of view.

Accordingly, it is the primary object of the present invention to provide a new and novel centrifugal pump assembly which is specifically intended for use in conjunction with ink reservoirs of printing presses.

It is another object of the present invention to provide a centrifugal pump assembly of the foregoing type employing releasable engaging means between the motor shaft and impeller shaft of the pump assembly.

It is still another object of the present invention to provide a centrifugal pump assembly of the foregoing type having means for enabling the motor of the pump assembly to be quickly and detachably secured to the reservoir cover plate.

It is still a further object of the present invention to provide a pump assembly of the foregoing type including releasably engageable coupling means between the motor shaft and impeller shaft of the pump assembly.

It is yet another object of the present invention to provide a centrifugal pump assembly as aforesaid including positive drive and alignment means between the coupling means and the impeller shaft to insure proper alignment of the impeller shaft in the impeller housing and proper rotational movement of the impeller shaft in correspondence with the motor shaft.

BRIEF DESCRIPTION OF THE DRAWINGS

The foregoing and other objects, features and advantages of the present invention will become more apparent from the detailed description hereinafter when considered in conjunction with the accompanying drawings wherein.

DETAILED DESCRIPTION OF THE PREFERRED EMBODIMENT

Figure 1:
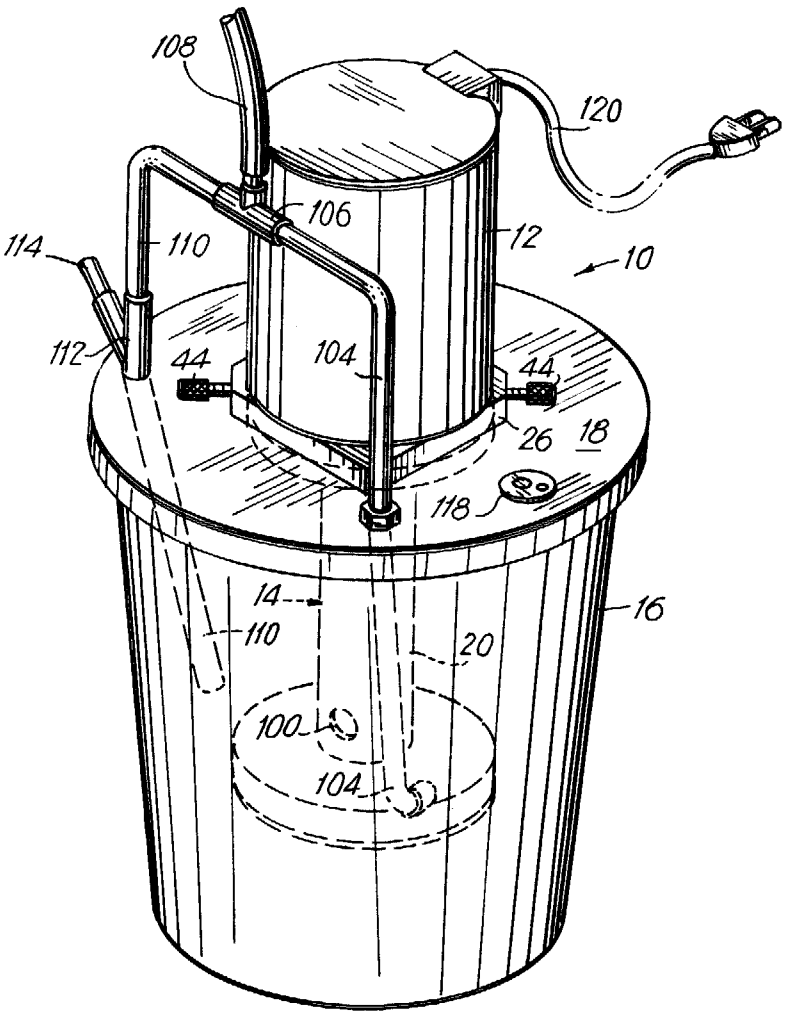
FIG. 1 is a perspective view of the new centrifugal pump assembly for use in conjunction with an ink reservoir.
Figure 3:
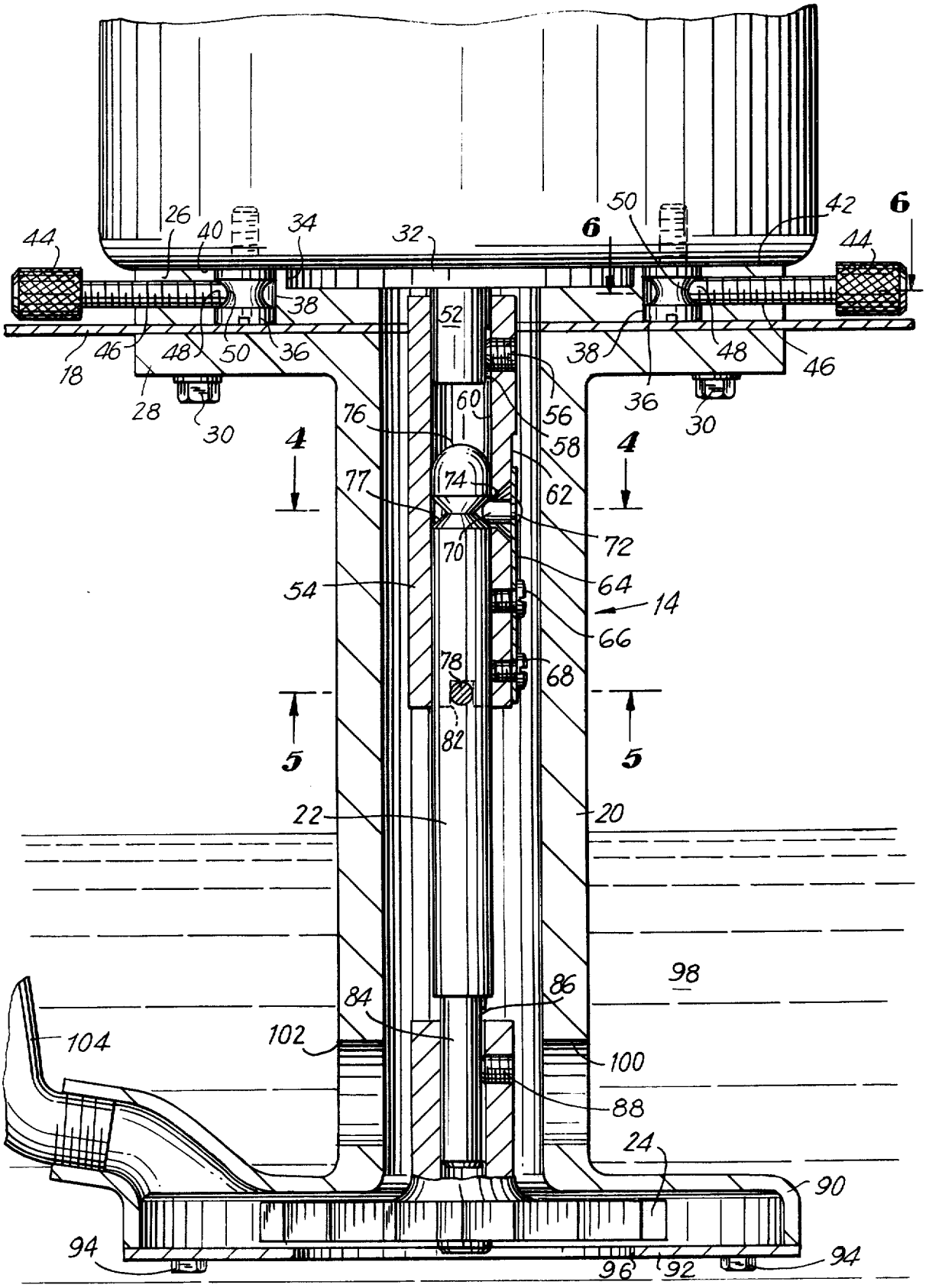
FIG. 3 is an expanded cross-sectional view of the centrifugal pump assembly depicted in FIG. 1.
Figure 4:
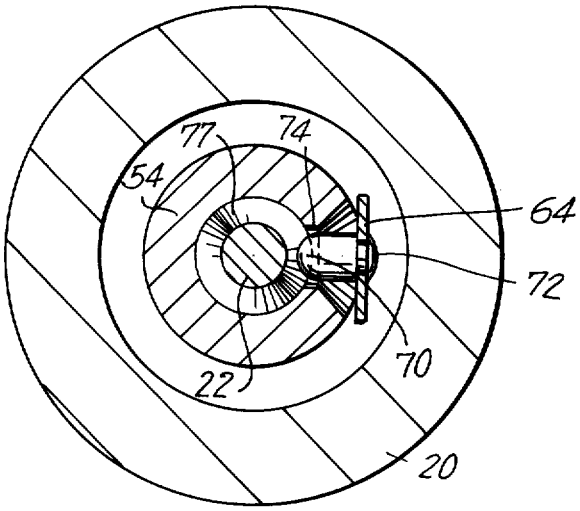
FIG. 4 is a sectional view taken on the line 4—4 of FIG. 3.
Figure 5:
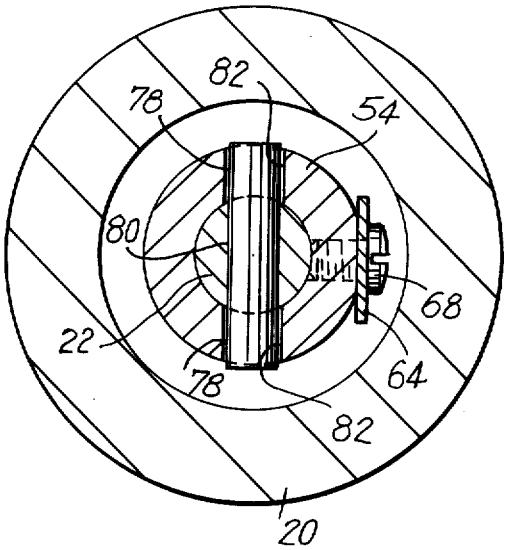
FIG. 5 is a sectional view taken on the line 5—5 of FIG. 3.
Figure 6:
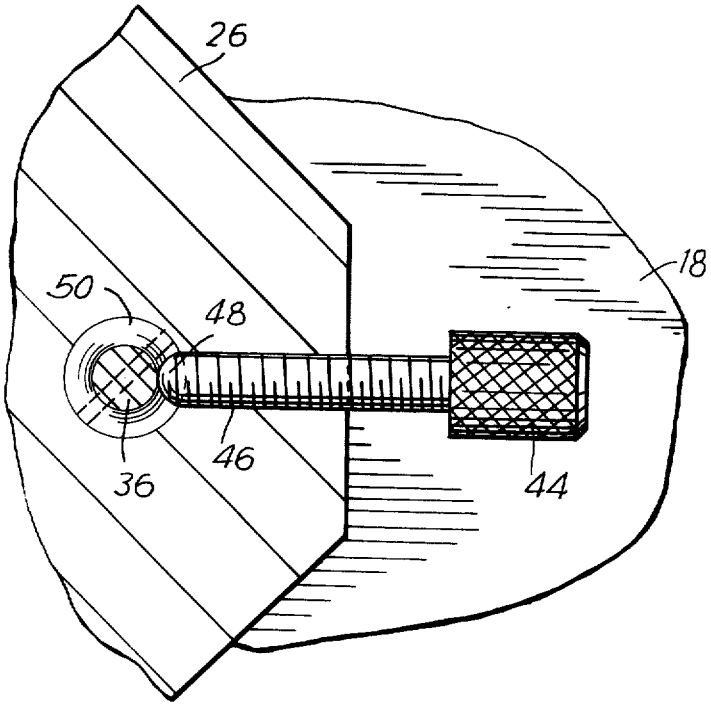
FIG. 6 is a sectional view taken on the line 6—6 of FIG. 3.

Referring now to FIG. 1, there is illustrated a perspective view of the centrifugal pump assembly in conjunction with the ink reservoir of a printing press, and which is constructed in accordance with the principles of the present invention. The pump assembly is generally denoted by the reference numeral 10 and includes the electrical motor 12 and the impeller assembly 14. The ink reservoir or vat 16 includes a cover member or plate 18. The impeller assembly 14 comprises the upper impeller housing portion 20, impeller shaft 22 and the impeller 24. The assembly 10 also includes a motor mounting hub 26. The hub 26 is positionally secured with respect to the cover plate 18 and to the upper housing portion 20, and more particularly, to the flange portion 28 of the upper impeller housing portion, by means of bolts 30 which pass through the upper flange portion 28, the cover plate 18 and the hub 26.

The motor 12 has an end wall 32, of substantially circular configuration, which is seated within a circular recess 34 formed in the hub 26. The motor also includes a pair of grooved locating studs 36 which are positionally disposed within bores 38 formed in the hub. In this regard, it is to be noted that the thickness of hub 26, and thus of bores 38, is substantially equal to the right of the external portion of the studs 36, wherefore the bottom end 40 of motor 12 is disposed in abutting engagement with the top 42 of hub 26. The motor 12 is secured in releasable engagement to the hub 26 by means of threaded knurled bolts 44 which extend through threaded lateral bores 46 in the hub 26. The rounded distal ends 48 of the bolts 44 are positionable in seated engagement in the peripheral grooves 50 of the motor locating studs 36 and, when in this position, secures the motor with respect to the hub.

The motor 12 includes a centrally disposed rotatable shaft 52 to which is secured a coupling sleeve 54 by means of a recessed set screw 56. It is to be noted that the shaft 52 is provided with a flat 58 slightly spaced from the inner bore 60 of the coupling sleeve 54 to enable secured engagement of the sleeve with respect to said shaft. The lower portion of sleeve 54 is provided with a recessed flat 62 to which a leaf spring 64 is secured by means of screws 66 and 68. A laterally protruding locator pin 70 is secured to the upper or free end of the leaf spring 64 by means of a riveted head 72. The pin 70 extends through a countersunk hole 74 formed in said sleeve and projects into the sleeve.

The upper end of the impeller shaft 22 is disposed within bore 60 in the sleeve 54 and the head 76 of shaft 22 is rounded to facilitate the insertion of the head into bore 60, as will be explained more fully hereinafter. When the head 76 is positioned within bore 60, proper vertical alignment of impeller shaft 22 and, more particularly, impeller 24 is obtained by engagement of the locator pin 70 within the V-shaped peripheral groove 77 formed in the upper end portion of shaft 22, adjacent head 76. Centrally disposed within shaft 22 and laterally extending therethrough is a drive pin 78 adapted to be engaged by the laterally extending slot 80 formed in sleeve 54 by means of diametrically opposed notches 82 provided in the lower end of sleeve 54. Seating engagement of the drive pin 78 in the slot 80 causes concomitant rotational movement of impeller shaft 22 with coupling sleeve 54, as will also be explained in more detail hereinafter. It is herein to be noted that the positioning of locator pin 70 within groove 77 cannot occur until drive pin 78 is engaged in slot 80.

The impeller shaft 22 is provided with a reduced lower portion 84 having a recessed flat 86. The impeller 24 is secured to impeller shaft portion 84 by a set screw 88 which abuttingly engages the flat 86. The lower portion of the impeller 24 is disposed within the impeller lower housing portion 90. The housing portion 90 is provided with an underside cover 92 secured thereto by means of bolts 94 and has a central inlet aperture 96.

In the operation of the centrifugal pump assembly 10, starting of the motor 12 causes rotational movement of motor shaft 52 and the coupling sleeve 54. By virtue of the positive engagement of drive pin 78 in slot 80, there is corresponding rotational movement of the impeller shaft 22 and thus of the impeller 24. Rotational movement of impeller 24, in turn, causes the inward flow of ink, generally denoted 98, through the inlet aperture 96 and inlet apertures 100 and 102 formed in impeller upper housing portion 20. The ink 98 is then pumped by centrifugal force upwardly through outlet tube 104 into a T coupling 106 provided with a bypass valve (not shown) which supplies the major portion of ink flowing in outlet tube 104 to a flexible tube 108 connected to the ink fountain (not shown) of the printing press. The valve also provides for a small amount of ink flow from tube 104 to the reservoir inlet tube 110. The flow of ink from tube 104 through T coupling 106 and tube 110 serves to produce a circulatory flow which keeps the ink 98 in reservoir 16 sufficiently mixed to prevent any residue or pigmentation settling from occuring therewithin. THe inlet tube 110 is also connected via coupling 112 to the fountain return tube 114 from whence the ink overflow from the fountain is returned to the reservoir 16.

Figure 2:
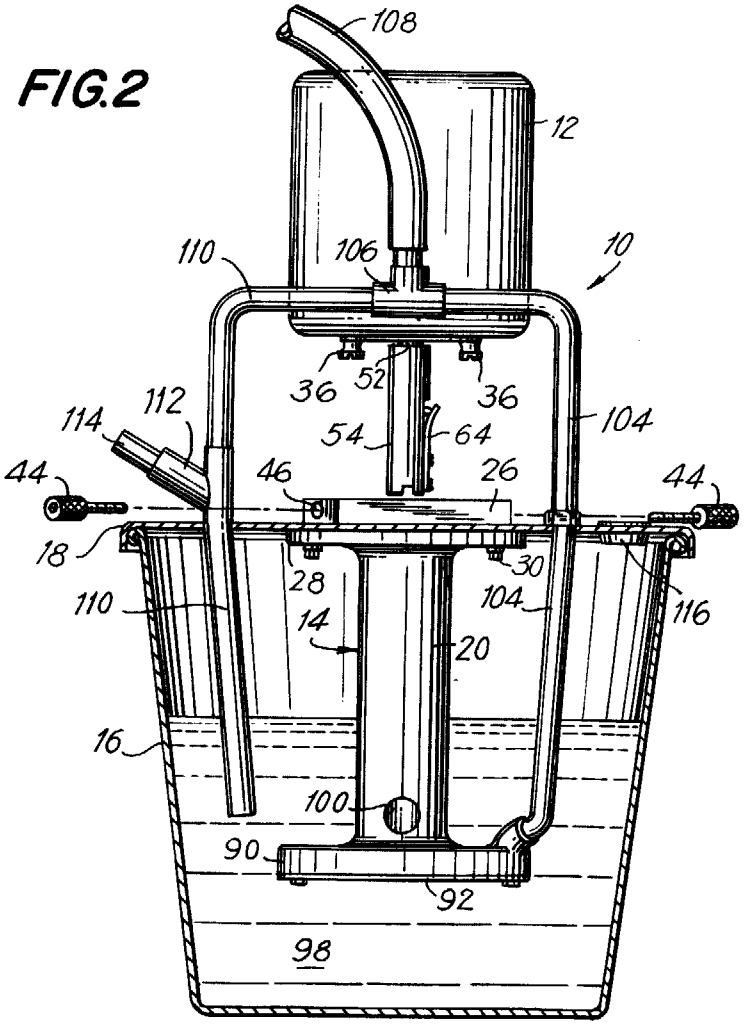
FIG. 2 is a partial sectional view of the centrifugal pump assembly of FIG. 1 with the component members thereof in their disassembled state.

As best seen in FIG. 2, the cover plate 18 is provided with a peep inlet hole 116 having pivotal cover 118. The peep hole 116 permits for visual inspection of the ink 98 and the provision of an additional amount of ink to the reservoir 16 without necessitating the cessation of operation of the centrifugal pump assembly; however, if desired the pump may be stopped and the entire cover member 18 may be lifted to provide an additional supply of ink to the reservoir.

When the pump assembly 10 has to be cleansed or repaired, the motor 12 is stopped and disconnected by removing the line cord 120 from the power receptacle. Thereafter the pump is disassembled by unscrewing knurled bolts 44 until the distal ends 48 thereof have become disengaged from the grooves 50. The motor 12 is then capable of being released from its engagement with hub 26 by merely lifting the same upwardly. This upward movement of motor 12 causes the coupling sleeve 54 secured to motor shaft 12 to become disengaged from impeller shaft 22 by causing the impeller shaft portion adjacent the V-shaped groove 77 to urge the locator pin outwardly of the hole 74 by deflection of the leaf spring 64. This also causes disengagement of the drive pin 78 from within the slot 80. After the sleeve 54 has been removed from the impeller shaft 22, the impeller 24 becomes misaligned with respect to the assembly 20 and abuts the lower housing portion 90, wherefore care must be taken to properly align the impeller 24 before restarting the pump assembly 10. Of course, separation of the coupling sleeve 54 from the impeller shaft 22 permits withdrawal of the sleeve from the circular recess 34, thereby separating the motor from the remainder of the pump assembly 10 and reservoir 16. The remainder of the pump assembly which includes the impeller assembly and reservoir may then be completely immersed in any type of solvent or cleansing solution without any danger of impairment or deleterious effect upon the motor 12.

After the impeller assembly 14 and reservoir 16 have been cleaned the pump assembly 10 is readily reassembled by insertion of the coupling sleeve 54 into upper impeller housing portion 20, In this regard, the person reassembling the pump need merely place the impeller hub upon a flat surface and then slowly rotate the motor a maximum of 180° until the slot aligns itself with the drive pin 78. Thereafter, the motor is permitted to descend a slight distance further until the groove 77 is disposed adjacent hole 74 and the locator pin 70. When this occurs, pin 70 seats itself within groove 77 and urges the impeller shaft 22 into proper vertical alignment which also causes proper alignment of impeller 24 within the lower housing portion 90. Thus, the cover plate 18 may thereafter be placed upon vat 16 and the pump assembly 10 is again ready for operation.

It is thus seen that we have provided a new and novel split shaft centrifugal pump arrangement wherein the motor is simply and readily releasably engageable with the impeller assembly, so as to effect quick engagement and disengagement of the motor and wherein, the motor shaft and impeller shaft are releasably engageable by positive drive connection means which also provides proper alignment of the pump components at the time of engagement.

While we have shown the preferred embodiment of our invention, it will be readily apparent to those skilled in the art that there are many modifications, changes and improvements which may be made therein without departing from the spirit and scope of the invention as hereinabove described.

What is claimed is:

1. A centrifugal pump apparatus comprising a motor assembly, and an impeller assembly, said motor assembly including a shaft mounted for rotational movement, said impeller assembly comprising, a housing having an upper portion and a lower portion, a shaft, and an impeller, coupling means disposed within said upper housing portion for releasably securing said motor shaft to said impeller shaft and for providing concomitant rotational movement of said impeller shaft with said motor shaft, means for securing said impeller to said impeller shaft, said motor shaft extending into said upper housing portion, and said coupling means including alignment means for longitudinally and laterally aligning said impeller within said lower housing portion and for positioning said motor shaft and said impeller shaft in coaxial alignment, said coupling means including a sleeve fixedly secured to said motor shaft and a drive member connected to said impeller shaft, said sleeve including a drive engaging member therein, and said drive engaging member engaging said drive member to provide said concomitant rotational movement.

2. A centrifugal pump apparatus in accordance with claim 1, wherein said drive member comprises a driving pin extending laterally through said impeller shaft, said drive engaging member comprising a pair of diametrically opposed notches formed in the bottom end of said sleeve and defining a laterally extending slot, and said driving member being engageable within said slot.

3. A centrifugal pump apparatus in accordance with claim 2, wherein said coupling means comprises a groove formed in said impeller shaft, and a locator pin laterally movable inwardly and outwardly of said sleeve, said locator pin being operative to become seated within said groove, and said seated engagement of said locator pin within said groove serving to releasably secure said sleeve with respect to said impeller shaft and positioning said impeller shaft in coaxial alignment with said motor shaft.

4. A centrifugal pump apparatus in accordance with claim 3, wherein said sleeve includes an aperture formed therein, a spring member secured to the outer surface of said sleeve, means for securing said locator pin to the free end of said spring member to permit lateral inward and outward movement of said locator pin through said aperture, and said pin being laterally movable in dependence upon the vertical movement of said impeller shaft.

5. A centrifugal pump apparatus in accordance with claim 4, wherein the upper end of said impeller shaft is rounded to facilitate the initial engagement of said sleeve and said impeller shaft.

6. A centrifugal pump apparatus in accordance with claim 4, wherein said groove formed in said impeller shaft is of V-shaped configuration and extends laterally about the peripheral surface of said impeller shaft.

7. A centrifugal pump apparatus in accordance with claim 4, wherein said aperture formed in said sleeve is a countersunk hole, thereby permitting pivotal movement of said locator pin through said aperture.

8. A centrifugal pump apparatus in accordance with claim 1, wherein said coupling means includes a groove formed in said impeller shaft, and a locator pin laterally movable inwardly and outwardly of said sleeve, said locator pin being operative to become seated within said groove, and said seated engagement of said locator pin within said groove serving to releasably secure said sleeve with respect to said impeller shaft and positioning said impeller shaft in coaxial alignment with said motor shaft.

9. A centrifugal pump apparatus in accordance with claim 8, wherein said sleeve includes an aperture formed therein, a spring member secured to the outer surface of said sleeve, means for securing said locator pin to the free end of said spring member to permit lateral inward and outward movement of said locator pin through said aperture, and said pin being laterally movable in dependence upon the vertical movement of said impeller shaft.

10. A centrifugal pump apparatus in accordance with claim 9, wherein the upper end of said impeller shaft is rounded to facilitate the initial engagement of said sleeve and said impeller shaft.

11. A centrifugal pump apparatus in accordance with claim 9, wherein said groove formed in said impeller shaft is of V-shaped configuration and extends laterally about the peripheral surface of said impeller shaft.

12. A centrifugal pump apparatus in accordance with claim 9, wherein said aperture formed in said sleeve is a countersunk hole, thereby permitting pivotal movement of said locator pin through said aperture.

13. In combination with an ink reservoir having a cover plate, a centrifugal pump apparatus comprising a motor assembly, and an impeller assembly, a motor mounting member secured to said cover plate, said motor mounting member having a substantially centrally disposed aperture formed therein, said motor assembly including a shaft mounted for rotational movement extending outwardly from the end wall thereof, said motor assembly being disposed in juxtaposed relationship with respect to said motor mounting assembly and said motor shaft extending through said aperture, said impeller assembly comprising a housing having an upper portion and a lower portion, a shaft, and an impeller, coupling means disposed within said upper housing portion for releasably securing said motor shaft to said impeller shaft and for providing concomitant rotational movement of said impeller shaft with said motor shaft, means for securing said impeller to said impeller shaft, said motor shaft extending into said upper housing portion, said coupling means including alignment means for longitudinally and laterally aligning said impeller with said lower housing portion and for positioning said motor shaft and said impeller shaft in coaxial alignment, means for securing said upper portion of the impeller housing to said cover plate, and means for detachably securing said motor assembly to said motor mounting member.

14. A combination in accordance with claim 13, wherein said means for detachably securing said motor assembly to said motor mounting member comprises
a plurality of studs secured to said motor assembly,
a plurality of substantially vertical bores formed in said mounting member,
a plurality of substantially lateral bores formed in said mounting member,
said lateral and vertical bores being disposed in perpendicularly intersecting axial alignment,
said studs being positionable within said vertical bores, and
means insertable into said lateral bores being operative to positionally secure said motor with respect to said motor mounting member.

15. A combination in accordance with claim 14, wherein
said lateral bores are threaded and said insertable means comprises threaded bolts having rounded distal ends,
said studs being provided with laterally extending peripheral grooves, and
said positional securement occuring upon seated engagement of the rounded distal ends of said bolts in the peripheral grooves of said studs.

16. A combination in accordance with claim 13, wherein
said coupling means includes a sleeve fixedly secured to said motor shaft,
said coupling means including a drive member connected to said impeller shaft,
said sleeve including a drive engagement member therein, and
said drive engaging member engaging said drive member to provide said concomitant rotational movement.

17. A combination in accordance with claim 16, wherein
said drive member comprises a driving pin extending laterally through said impeller shaft,
said drive engaging member comprising a pair of diametrically opposed notches formed in the bottom end of said sleeve and defining a laterally extending slot, and
said driving member being engageable within said slot.

18. A combination in accordance with claim 17, wherein
said coupling means comprises
a groove formed in said impeller shaft, and
a locator pin laterally movable inwardly and outwardly of said sleeve,
said locator pin being operative to become seated within said groove, and
said seated engagement of said locator pin within said groove serving to releasably secure said sleeve with respect to said impeller shaft and positioning said impeller shaft in coaxial alignment with said motor shaft.

19. A combination in accordance with claim 18, wherein said sleeve includes an aperture formed therein,
a spring member secured to the outer surface of said sleeve,
means for securing said locator pin to the free end of said spring member to permit lateral inward and outward movement of said locator pin through said aperture, and
said pin being laterally movable in dependence upon the vertical movement of said impeller shaft.

20. A combination in accordance with claim 19, wherein
said groove formed in said impeller shaft is of V-shaped configuration and extends laterally about the peripheral surface of said impeller shaft.

21. A combination in accordance with claim 19, wherein
said aperture formed in said sleeve is a countersunk hole, thereby permitting pivotal movement of said locator pin through said aperture.

22. A combination in accordance with claim 13, wherein
said coupling means comprises
a groove formed in said impeller shaft, and
a locator pin laterally movable inwardly and outwardly of said sleeve,
said locator pin being operative to become seated within said groove, and
said seated engagement of said locator pin within said groove serving to releasably secure said sleeve with respect to said impeller shaft and positioning said impeller shaft in coaxial alignment with said motor shaft.

23. A combination in accordance with claim 22, wherein
said sleeve includes an aperture formed therein,
a spring member secured to the outer surface of said sleeve,
means for securing said locator pin to the free end of said spring member to permit lateral inward and outward movement of said locator pin through said aperture, and
said pin being laterally movable in dependence upon the vertical movement of said impeller shaft.

24. A combination in accordance with claim 22, wherein
the upper end of said impeller shaft is rounded to facilitate the initial engagement of said sleeve and said impeller shaft.

25. A combination in accordance with claim 22, wherein
said groove formed in said impeller shaft is of V-shaped configuration and extends laterally about the peripheral surface of said impeller shaft.

26. A combination in accordance with claim 22, wherein
said aperture formed in said sleeve is a countersunk hole, thereby permitting pivotal movement of said locator pin through said aperture.

* * * * *